United States Patent [19]

Lobato

[11] Patent Number: 4,646,770

[45] Date of Patent: Mar. 3, 1987

[54] WIND-DEFLECTOR AND SHELTER APPARATUS

[76] Inventor: Matthew P. Lobato, 15555 Huntington Village La., No. 115, Huntington Beach, Calif. 92647

[21] Appl. No.: 695,550

[22] Filed: Jan. 28, 1985

[51] Int. Cl.[4] ..... E04H 15/36; E04H 15/40; E04H 15/44; E04H 15/02

[52] U.S. Cl. ..... 135/102; 135/104; 135/106; 135/900; 135/901

[58] Field of Search ..... 135/95, 102, 103, 104, 135/109, 117, 106, 105

[56] References Cited

U.S. PATENT DOCUMENTS

| | | | |
|---|---|---|---|
| 2,036,033 | 3/1936 | Fisher | 135/102 |
| 2,266,853 | 12/1941 | Dabney | 135/104 |
| 2,689,579 | 9/1954 | Sartori | 135/96 X |
| 2,932,833 | 4/1960 | Wambach | 5/434 |
| 3,082,780 | 3/1963 | Macy | 135/102 |
| 3,909,993 | 10/1975 | Huddle | 52/63 |
| 4,332,266 | 6/1982 | Wageley | 135/109 |
| 4,402,544 | 9/1983 | Artim et al. | 135/102 X |

FOREIGN PATENT DOCUMENTS 0943744 12/1963 United Kingdom ..... 135/106

OTHER PUBLICATIONS

Webster's Third New International, Unabridged Dictionary, Definitions: "Hyperbola", Parabola, 1961.

*Primary Examiner*—Richard J. Johnson
*Assistant Examiner*—Terrence L. B. Brown
*Attorney, Agent, or Firm*—Willie Krawitz

[57] ABSTRACT

The present invention relates to a portable, self-anchoring, wind-deflector and shelter structure having a unique configuration so as to employ the impinging wind forces to create the self-anchoring arrangement. The structure is formed with a base member defining a floor having an arcuate rear edge and a longitudinal front edge which forms either a parabolic or hyperbolic configuration, and includes an upright wall being angularly disposed to the base member. The wall is further formed with a compound-curved surface that includes oppositely positioned, tapered, wind channels which allow the wind to blow in a forward and downward direction against the base member, thus causing the structure to be fixed in a stabilized position while subjected to high wind velocities.

7 Claims, 7 Drawing Figures

FIG. 1
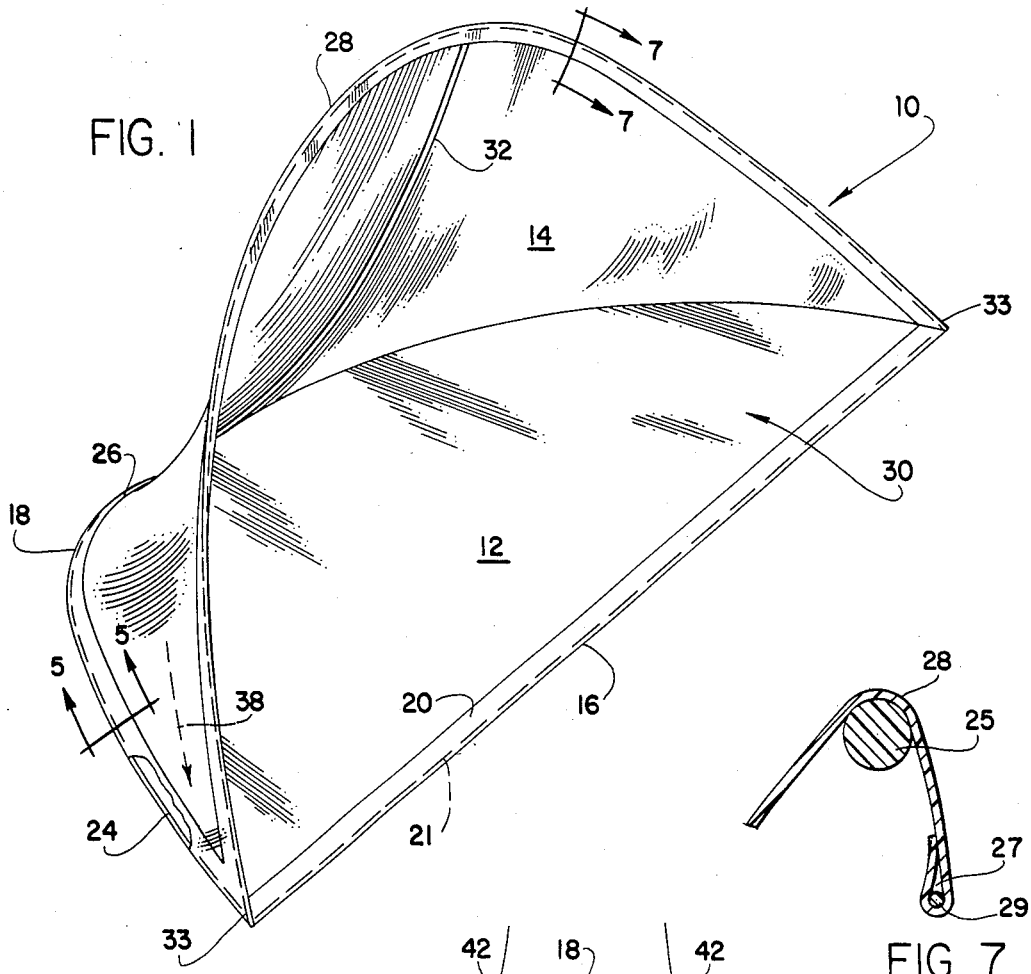
FIG. 7.
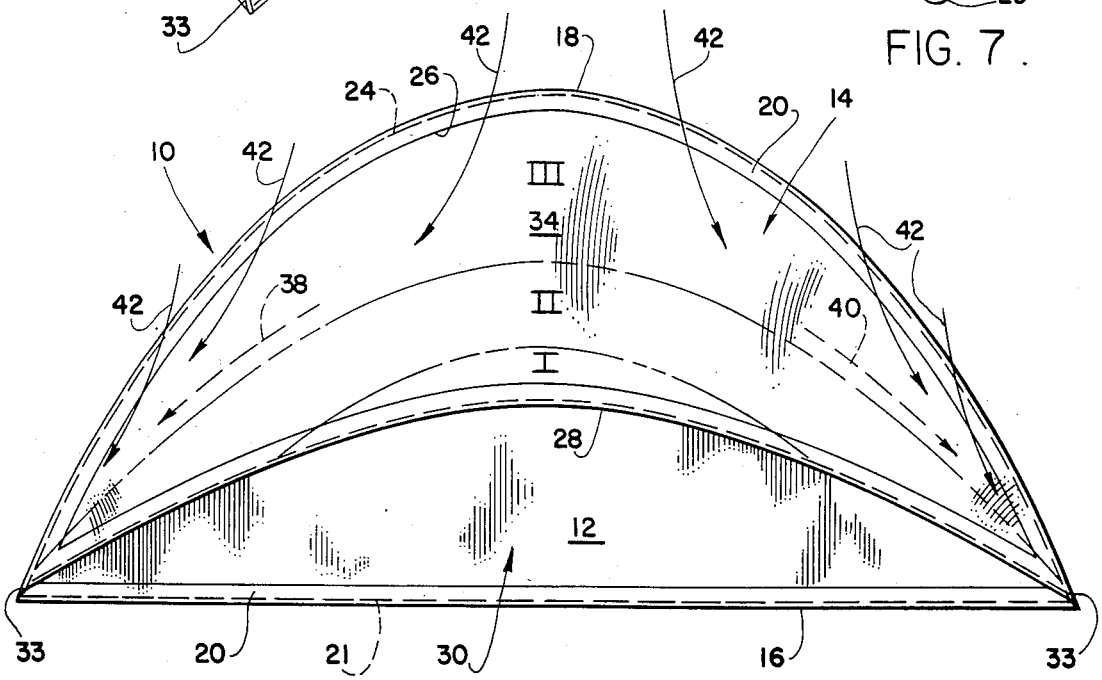
FIG. 2

WIND-DEFLECTOR AND SHELTER APPARATUS

BACKGROUND OF THE INVENTION

1. Field of the Invention

This invention relates to a wind-deflector and shelter apparatus, and more particularly to a lightweight, portable, collapsible shelter especially suited for the beach, and having a configuration uniquely designed to allow the structure to remain in a fixed stablized position, even while subjected to high wind velocity, since most of the impinging wind is directed downwardly on the apparatus.

2. Description of the Prior Art

Until the development of the present invention, there was no provision or suitable means for anchoring portable-type wind shelters. The known structures must be tied down to other structures, or secured by means of inserting spikes into the supporting ground area, including the use of tie-down ropes or like devices.

In many cases, the known tie-down devices have not been found to prevent shelters from overturning or being pulled from their fixed anchoring members. This is particularly a problem in beach areas where the sand does not provide an ideal anchoring The known types of shelters have basic design configurations that have been commonly in use for many years. These shelters and wind deflectors are so formed as to provide a lifting action as the force of the wind impinges against their walls.

As examples of such known shelters, one may refer to U.S. Pat. No. 2,266,853, entitled COLLAPSIBLE SHELTER; U.S. Pat. No. 3,190,300, entitled PORTABLE SHELTER ARRANGEMENT; U.S. Pat. No. 3,242,935, entitled FOLDABLE SHELTER; and U.S. Pat. No. 3,405,721, entitled COLLAPSIBLE AND PORTABLE CABANA.

All of the above patents do not have the proper configuration to establish a balanced structure so that the force of the wind would not affect their stability.

Thus, there is a need for a wind-deflector and shelter apparatus designed to take advantage of the wind forces, so that the wind itself creates an anchoring means for the overall structure, thus causing the shelter to become more firmly anchored as the velocity of the wind increases.

SUMMARY AND OBJECTS OF THE INVENTION

The present invention has for an important object to provide a wind deflector and shelter having a unique compound-curved wall structure which is secured to a base member formed having a hyperbolic or parabolic configuration, thus establishing a self-stabilizing wind deflector and shelter.

It is another object of the present invention to provide a very-lightweight, portable, wind deflector and shelter designed so as to have a compound-curved wall structure, whereby the winds impinging upon the structure create a primarily downward draft so as to cause the body of the overall structure to anchor itself to the ground and be supported, rather than create an upward draft which would tend to lift the shelter or wind deflector, as is the case with the known shelters.

Still another object of the invention is to provide a wind deflector that is formed with a base member having either a parabolic or hyperbolic configuration, and a substantially upright wall formed having a compound-curved formation. The perimeter of the deflector defines a parabolic or hyperbolic opening, whereby the upright wall structure is arranged to funnel the majority of the wind forces in a downward and forward direction, thus causing the base to be forced in a vertically downward direction so that the deflector engages the ground surface in a firm and stable manner.

It is still another object of the invention to provide a structure of this character wherein no anchoring devices are needed to assist in securing the structure during wind velocities of up to approximately 50 m.p.h.

A further object of the invention is to provide a wind deflector of this character that comprises a wall and base member formed from a very-lightweight sheet material (preferably nylon) having flexible support rods mounted within the peripheral edges thereof, a center support rod being disposed between the vertex of the base member and vertex of the wall members. The nylon fabric is stretched between the juxtaposed arches of the base and wall members, so as to define a compound-curved wall surface which directs horizontal wind flow along the leading surface of the compound convex configuration in such a manner that most of the wind forces are directed downwardly against the majority of the surface area of the wall structure, thereby causing a greater total vertical force, rather than a horizontal force, against the compound-curved surface.

Still a further object of the present invention is to provide a structure of this character wherein the curved arched surface and the floor base form a shape that allows for lower air pressure behind and inside the leading arched face, the resulting back pressure thus preventing the deflector/shelter from lifting in an upward direction.

It is a further object of the invention to provide an apparatus of this type that is easy to assemble and maintain, and is also relatively inexpensive to manufacture.

Still another object of the invention is to provide a wind deflector and shelter that is simple in structure and yet rugged in construction, so as to withstand relatively high wind velocities.

The characteristics and advantages of the invention are further sufficiently referred to in connection with the accompaning drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Other features and advantages of the instant invention will be obvious to persons skilled in the art from the following detailed description of a preferred embodiment accompanied by the attached drawings in which identical reference numerals will refer to like parts in the various views.

FIG. 1 is a perspective view of the present invention showing the shelter opening defined by the angularly positioned vertical wall and the floor base, the opening and the base having a hyperbolic configuration further defining a conic section;

FIG. 2 is a top-plan view thereof showing the three areas of wind deflection;

FIG. 7 is an enlarged cross-sectional view taken along line 7—7 of FIG. 1 thereof. cl DESCRIPTION OF THE PREFERRED EMBODIMENT Referring more particularly to FIGS. 1 and 2, there is shown the present invention which defines a wind-deflector and shelter apparatus, generally indicated at 10. The apparatus is formed having a floor or base member 12 and an angularly disposed substantially upright wall 14. The base member 12 is further formed from a very-thin lightweight material such as a suitable nylon fabric. The front longitudinal edge 16 together with the rear arcuate edge 18 define a conic section shaped as either a parabola or hyperbola, but preferably in a hyperbolic configuration The front longitudinal edge 16 is formed having an adjusting means comprising an elongated sleeve 20 in which a draw string 21 is disposed to provide an adjusting means for tension, when required.

Figure 5:
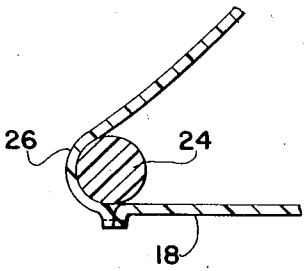
FIG. 5 is an enlarged cross-sectional view taken substantially along line 5—5 of FIG. 1.

A removable framework is also incorporated by means of a pair of arcuate flexible poles or rods 24 and 25. Rod 24 is positioned along the connection between edge 18 of base 12 and the lower edge 26 of wall 14, as seen in FIG. 5. Rod 25 is placed along the upper edge 28 which is formed with an adjusting means having a sleeve 27 to receive draw string 29. Thus, the tension of the wall and floor materials can each be adjusted so as to achieve the proper form and tension.

Hence, wall structure 14 is also made from the same stretchable nylon fabric and has a basically crescent-shaped configuration, the lower edge 26 thereof being shaped to correspond to the arcuate vertex of the hyperbolic-shaped base. Lower edge 26 is secured to arcuate edge 18 by sewing or other suitable means. (See FIG. 5.) The oppositely disposed, upper, free edge 28 is formed so as to establish a front opening 30 in conjunction with front edge 16 of base 12, as illustrated in FIG. 1. The upper free edge 28 is formed having a sleeve 27 in which draw string 29 is received, so as to firmly establish the desired arched opening 30. However, a central support rod 32 is interposed between vertex edge 18 and the vertex edge 28 of wall structure 14, as seen in FIG. 1. The central support rod 32 may be mounted therebetween in any suitable manner.

Figure 6:
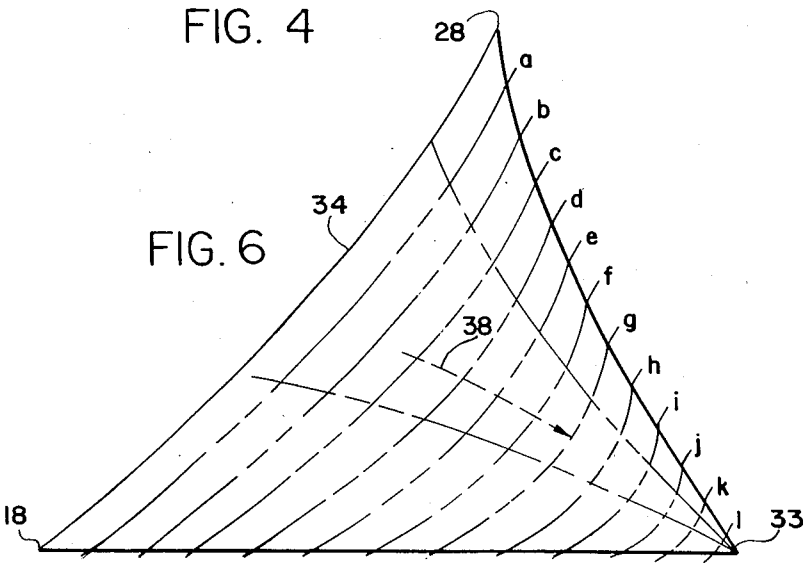
FIG. 6 is a diagrammatic side-elevational view of the present invention, the phantom lines indicating the cross-sectional configuration at various intervals along the compound-curved wall structure.

It is important to note that the terminated ends of all the respective edges 18, 26 and 28 converge and are joined at their respective opposite ends 33 of front edge 16. Due to the combination of the lower and upper vertex edges and their respective angular positions relative to each other, wall structure 14 forms a compound-curved surface. That is, wall structure 14 forms a somewhat horizontal bowed surface terminating at end 33, the bowed surface further providing a transverse concaved configuration. This combination of a bowed/concaved surface defines a compound wind-channelling means, the largest concave portion 34 of the outer surface being located between the central portions of the oppositely disposed vertex edges 18 and 28. Further, the oppositely disposed, lateral-extending portions of the outer surfaces (indicated by arrows 38 and 40) have progressively reduced widths of concave cross-sectional configurations, as indicated by phantom lines (marked "a" through "1") illustrated in FIG. 6. Hence, the portions indicated by arrows 38 and 40 define tapered channels, whereby the wind blowing against the outer rear surface will be directed evenly about the structure through channels 38 and 40, indicated by arrows 42 in FIG. 2. To further direct the wind with a vertically downward force against the base of the structure, channels 38 and 40 are tapered inwardly, thus converging at the free ends 33.

Figure 4:
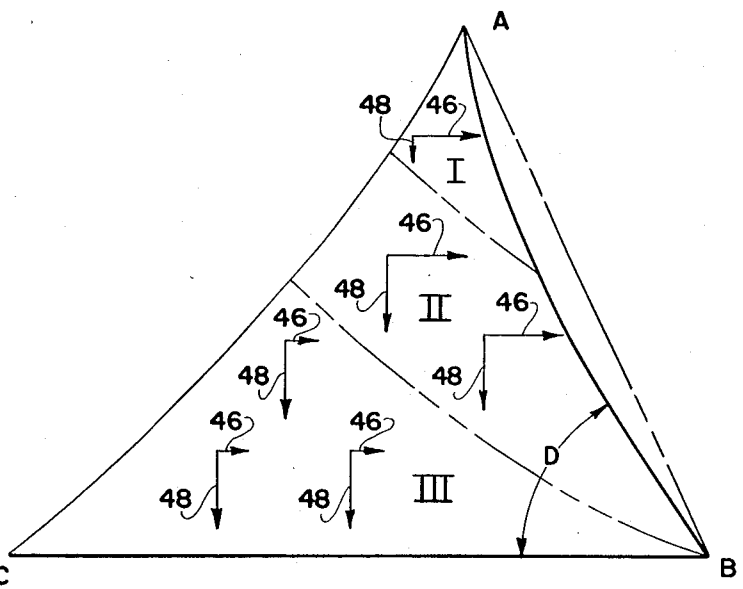
FIG. 4 is a diagrammatic side view thereof indicating vector direction of wind force.
Figure 3:
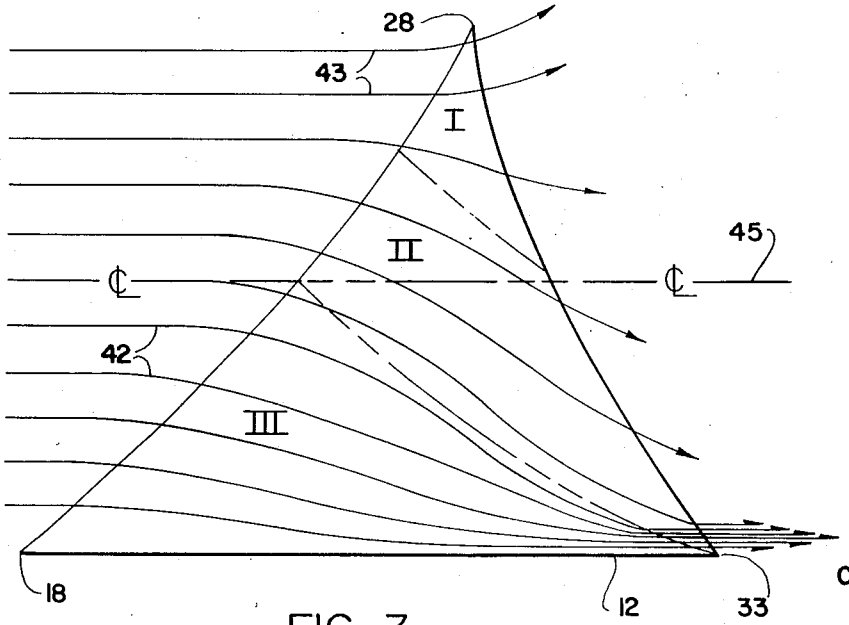
FIG. 3 is a diagrammatic, side-elevational view of the wind deflector and shelter indicating the direction of wind flow.

Referring now to FIG. 3, it can be seen that winds (indicated by arrows 42 and 43) are not only directed around the structure but are additionally directed both upwardly as well as downwardly. However, due to this unique configuration, the blowing wind indicated at 43 is directed upwardly over the top portion of the structure indicated by apex section I. The wind indicated by 42 tends to impinge in a downward direction beginning in the lower area of section I and further downwardly into section II. It is to be noted that the winds in section III provide the greater downward force against base 12. FIG. 3 further illustrates that the downward forces of the wind shown at 42 begin well above the horizontal center line 45 of the structure. FIG. 4 diagrammatically shows the vector direction of the wind force, wherein 46 represents horizontal forces and 48 represents downward forces with respect to each section I, II and III.

There are two additional factors that must be considered in achieving the unique end result provided by the present invention—that being that the force of the wind itself will act as an anchoring means. One factor is that the point "A" must be angularly positioned from point "C" at between 45° and 82°, indicated at "D" in FIG. 4. Thus, the upper arch defined by edge 28 is angularly disposed to the arch defined by edge 18. The other factor is that the length of "AB" should be equal to or less than the length of "BC", "B" representing the front edge 16 of base 12, and "C" representing the vertex thereof.

With the configuration as herein described, the curved arched surface of the wall together with the floor base form a unique shape that creates a lower air pressure behind and inside the leading arched face, and a resulting back pressure assists in keeping the structure from lifting upwardly, without the need for anchoring or tie-down devices as are presently required with the known apparatuses.

It may be thus seen that the objects of the invention set forth as well as those made apparent from the foregoing description are efficiently attained. While a preferred embodiment of the invention has been set forth for purposes of disclosure, modifications of the disclosed embodiment of the invention as well as other embodiments thereof may occur to those skilled in the art. Accordingly, the appended claims are intended to cover all embodiments which do not depart from the spirit and scope of the present invention.

What I claim is:

1. A portable, self-anchoring, wind-deflector and shelter structure, comprising:

(a) a base member defining a floor formed having an arcuate rear edge and a longitudinal front edge defining a hyperbolic configuration, said base member being adapted to be supported on a ground surface;

(b) a wall structure having a compound-curved surface when in an erected form, said wall structure being defined by a rear, hyperbolic, lower edge integrally secured to said arcuate rear edge of said base member and an upper, hyperbolic, free edge of said wall structure, and said upper free edge and said longitudinal front edge of said base member define a front opening to said structure; and (c) said compound-curved surface forming a pair of oppositely disposed, tapered, wind channels whereby horizontal wind impinging upon said compound-curved surface is deflected downwardly and forwardly, thus forcing said base member against said supporting ground surface;

(d) wherein each of said tapered wind channels is formed having a concave, upwardly directed, cross-sectional configuration and a curvilinear configuration, whereby the tapered configuration thereof is defined by the converging of said arcuate rear edge of said base member and said upper hyperbolic free edge; wherein said structure includes a removable framework comprising:

(e) a first flexible pole member positioned adjacent said arcuate rear edge of said base member; and, a second flexible pole member positioned adjacent said upper free edge of said wall structure; and (f) at least one support rod to separate the rear lower edge and the upper free edge of said structure.

2. A portable, self-anchoring, wind-deflector and shelter structure as recited in claim 1, wherein said compound-curved surface is curved in an upwardly concave direction and in a curvilinear direction.

3. A wind-deflector and shelter structure as recited in claim 1, wherein said upper, hyperbolic, free edge of said wall structure and said longitudinal front edge of said base member include tensioning means to control the arch and width of said front opening defined thereby.

4. A wind-deflector and shelter structure as recited in claim 1, wherein the angular position between the vertex of the arcuate front opening and the vertex of the arcuate rear edge of said base member is greater than 45° and less than 82°.

5. The shelter structure of claim 4 in which the support rod is equal to or less than the length of the front edge of the base member.

6. The shelter structure of claim 1 in which the support rod is equal to or less than the length of the front edge of the base member.

7. The shelter structure of claim 1 in which the support rod is centrally disposed between the rear lower edge and the upper free edge of the structure.

* * * * *